US006382962B1

(12) United States Patent
Papai

(10) Patent No.: US 6,382,962 B1
(45) Date of Patent: May 7, 2002

(54) VENTING COVER FOR A CONTAINERIZED CANDLE

(76) Inventor: Tod A. Papai, 2102 Michigan Ave., LaPorte, IN (US) 46350

( * ) Notice: Subject to any disclaimer, the term of this patent is extended or adjusted under 35 U.S.C. 154(b) by 0 days.

(21) Appl. No.: 09/925,893

(22) Filed: Aug. 9, 2001

Related U.S. Application Data

(63) Continuation-in-part of application No. 09/575,447, filed on May 22, 2000, now abandoned

(60) Provisional application No. 60/144,683, filed on Jul. 20, 1999.

(51) Int. Cl.[7] ..... F21L 19/00; F21V 37/02; F21V 35/00

(52) U.S. Cl. ..... 431/291; 431/289; 362/163; 362/180

(58) Field of Search ..... 431/8, 288, 289, 431/291, 310, 311, 312, 313, 314, 320, 309, 300, 144; 362/180, 161, 163; 126/45; D26/6, 7, 9, 11

(56) References Cited

U.S. PATENT DOCUMENTS 1,389,490 A * 8/1921 Cook et al.
1,867,420 A * 7/1932 Root
1,915,622 A * 6/1933 Sevcik
1,975,496 A * 10/1934 Barrett, Jr.
2,050,151 A * 8/1936 Baumer
2,254,664 A * 9/1941 Quinlan
2,274,823 A * 3/1942 Candy, Jr.
2,291,072 A * 7/1942 Dahle

FOREIGN PATENT DOCUMENTS

DE 2618394 * 1/1978 ..... 431/291
DE 2804589 A1 * 8/1979 ..... 431/291

OTHER PUBLICATIONS

DT–2804589, English Language Translation, (No Publication Date).*

* cited by examiner

*Primary Examiner*—Carl D Price
(74) *Attorney, Agent, or Firm*—R. Tracy Crump

(57) ABSTRACT

A venting cover for a containerized candle that stabilizes the combustion flame and improves the efficiency of the combustion of containerized candles is disclosed. The venting cover of this invention is a flat disc, which is seated over the mouth of the container or jar. The venting cover has an annular flange around its periphery, a central exhaust vent and six oblong inlet vents spaced radially from the exhaust vent around the periphery of the venting cover. The venting cover creates a concentric laminar air flow within the interior of the jar, which stabilizes the flame and improves the efficiency of the combustion.

6 Claims, 3 Drawing Sheets

VENTING COVER FOR A CONTAINERIZED CANDLE

This is a continuation-in-part of U.S. patent application, Ser. No. 09/575,447, filed on May 22, 2000, now abandoned, which claims benefit of U.S. provisional patent application, serial No. 60/144,683, filed Jul. 20, 1999. This invention relates to decorative containerized candles, and particularly to a cover for a containerized candle which improves the candle's combustion and eliminates candle smoke.

BACKGROUND OF THE INVENTION

Containerized candles have been well known for hundreds of years. Candles were first placed in containers as an improvement over conventional candle sticks. When a candle burns, the heat generated by the flame melts a layer of the wax around the flame, which is drawn up by the wick to feed the flame. Much of the candle wax, which fuels the candle flame, melts and runs down the body of conventional candle sticks, which not only reduces the longevity of the candle, but also detracts from the appearance of the candle. Containerized candle have the tallow or wax and wick contained in a transparent or translucent vessel, such as a glass apothecaryjar. Containerized candles enclose the wax within the vessel, which prevents the loss of wax from run off and allows for a more decorative presentation. Containerized candles in glass apothecary jars have become increasingly popular, and are general referred to as apothecary jar candles.

One drawback of containerized candles is the efficiency of their combustion. It is well known that the flame in a candle is a diffusion combustion flame. The flame is a reaction front (or wave) in a gaseous medium into which the reactants flow and out of which the products flow. Diffusion flames occur when fuel and oxidizer mix and burn simultaneously. In a candle, the candle wax is consumed as a fuel and the oxidizer is oxygen from the atmosphere drawn in a convection stream toward the base of the flame. The candle wax is melted and vaporized by the heat of the flame and emerges as a steady stream of vapor from the wick. The candle wax is rich in hydrocarbons, which are consumed in the exothermic reaction of the flame. Hot incandescent carbon particles in the flame make it appear yellow. If sufficient ambient air is not drawn to the base of the flame to oxidize the carbon particles in later stages of combustion, the flame will be smoky, and the exhaust will contain dark carbon residue, smoke. Consequently, providing a sufficient air flow is critical for a clean or smokeless combustion.

Heretofore, providing sufficient air flow to the base of the flame in a containerized candle has been a problem. While the vessel prevents the run off of melted wax and contains the thermal energy to melt more wax near the wick, the container limits and obstructs the air flow to the flame, which is needed for the combustion process. Ambient air must simultaneously be drawn downward into the containerwhile hot exhaust vents out of the container. Hot exhaust from the flame rises upward in a convection flow, which creates a negative pressure to draw cool ambient air into the interior toward the base of the flame. Passing through the mouth of the container, the proximity of the opposing exhaust and intake airflows create turbulence within the container interior. The turbulence within the container increases proportionately to proximity between the exhaust and intake air flows, as well as, the temperature and velocity differentials of the air flows. The turbulent air flow within the container restricts and retards flow of the ambient air to the base of the flame. Consequently, the combustion in containerized candles often produces smoke. Turbulence within the container also destabilizes the flame, and can even extinguish it. The instability of the flame is evidenced by the flicker of the flame, which is common in containerized candles.

In addition, "tunneling" has been a problem for large diameter candles whether containerized or not. The thermal energy released in the combustion of conventional candle waxes can only melt a thin layer of wax with a limited cross-sectional area. Consequently, "tunneling" occurs when the cross-sectional area of the solid candle wax is much greater than the cross-sectional area of the melted candle wax around the flame. As the melted candle wax is consumed by the flame, the flame descends down into a cylindrical cavity or "tunnel" within the solid candle wax. Eventually the flame becomes encircled within this "tunnel" of candle wax. The quantity of solid candle wax which forms the tunnel walls is lost to the candle as a fuel source, simply due to the inability of the flame to melt the remote solid wax.

Since the candle wax and flame are enclosed, containerized candles can have slightly greater diameters than conventional stick candles. The glass enclosure partially insulates the thermal energy from the combustion so that more solid wax can be melted. Nevertheless, the thermal energy released in the combustion of conventional candle waxes still limits the maximum diameter of single wick containerized candles to approximately three inches. As the diameter of containerized candles begins to exceed three inches tunneling begins to become a problem. With air flow within the container already inherently restricted, tunneling can prematurely limit the life of a containerized candle. Furthermore, the in flow of ambient air to the base of the flame can become so constricted by the tunneling effect within a containerized candle that the flame extinguishes for lack of oxidation.

SUMMARY OF THE INVENTION

The containerized candle venting cover of this invention stabilizes the combustion flame and improves the efficiency of the combustion of conventional containerized candles. The venting cover reduces turbulence in containerized candles by facilitating separated concentric laminar air flow within the candle container. The concentric laminar air flow inside the candle container enables sufficient ambient air flow directly to the base of the flame so that the flame burns more efficiently, i.e., brighter, hotter and with reduced smoke.

The venting cover of this invention can be used with any conventional containerized candle, but is ideally suited for use with conventional three inch apothecary jar candles. The venting cover of this invention is a flat disc, which is seated over the mouth of the container or jar. The venting cover has an annular flange around its periphery, a central exhaust vent and six oblong inlet vents spaced radially from the exhaust vent around the periphery of the venting cover. The venting cover creates a concentric laminar air flow within the interior of the jar, which stabilizes the flame and improves the efficiency of the combustion. The upward convection flow of the hot exhaust air from the flame exits the jar directly through the exhaust vent in the venting cover. The negative pressure inside the jar created by the convection flow of the exhaust air draws cool ambient air into the jar through the six inlet vents. This intake air flow circulates concentrically downward along the inside of the jar wall and converges toward the wick at the base of the flame.

The venting cover restricts the volume and velocity of the airflow that exits and enters the interior of the jar. The orientation of the exhaust vent and the surrounding six inlet vents provides concentric laminar air flow within the jar, which stabilizes the flame and permits sufficient air flow directly to the base of the flame. The exhaust vent is positioned directly above the candle flame, which focuses the convection draft of exhaust air directly upwards, thereby reducing the diffusion of the exhaust flow inside the jar. The six intake vents are spaced radially from the exhaust vent to separate the exhaust and intake air flows. The separation of the opposing air flows reduces turbulence within the interior of the jar, which leads to cleaner, more efficient combustion.

Accordingly, an advantage of this invention is that the venting cover stabilizes the combustion flame and improves the efficiency of the combustion of conventional containerized candles.

Another advantage is that the venting cover reduces the smoke produced in the combustion process of containerized candles.

Another advantage is that the venting cover reduces turbulence in containerized candles by facilitating separated concentric laminar air flow within the candle container, which enables sufficient ambient air flow directly to the base of the flame.

Another advantage is that the apparatus improves the efficiency of the containerized candle without detracting from the decorative appearance of the candle.

Another advantage is that the apparatus can be used on any large mouthed containerized candle.

Other advantages will become apparent upon a reading of the following description.

BRIEF DESCRIPTION OF THE DRAWINGS

The preferred embodiments of the invention have been depicted for illustrative purposes only wherein.

DESCRIPTION OF THE PREFERRED EMBODIMENT

The preferred embodiment herein described is not intended to be exhaustive or to limit the invention to the precise form disclosed. It is chosen and described to explain the invention so that others skilled in the art might utilize its teachings.

Figure 1:
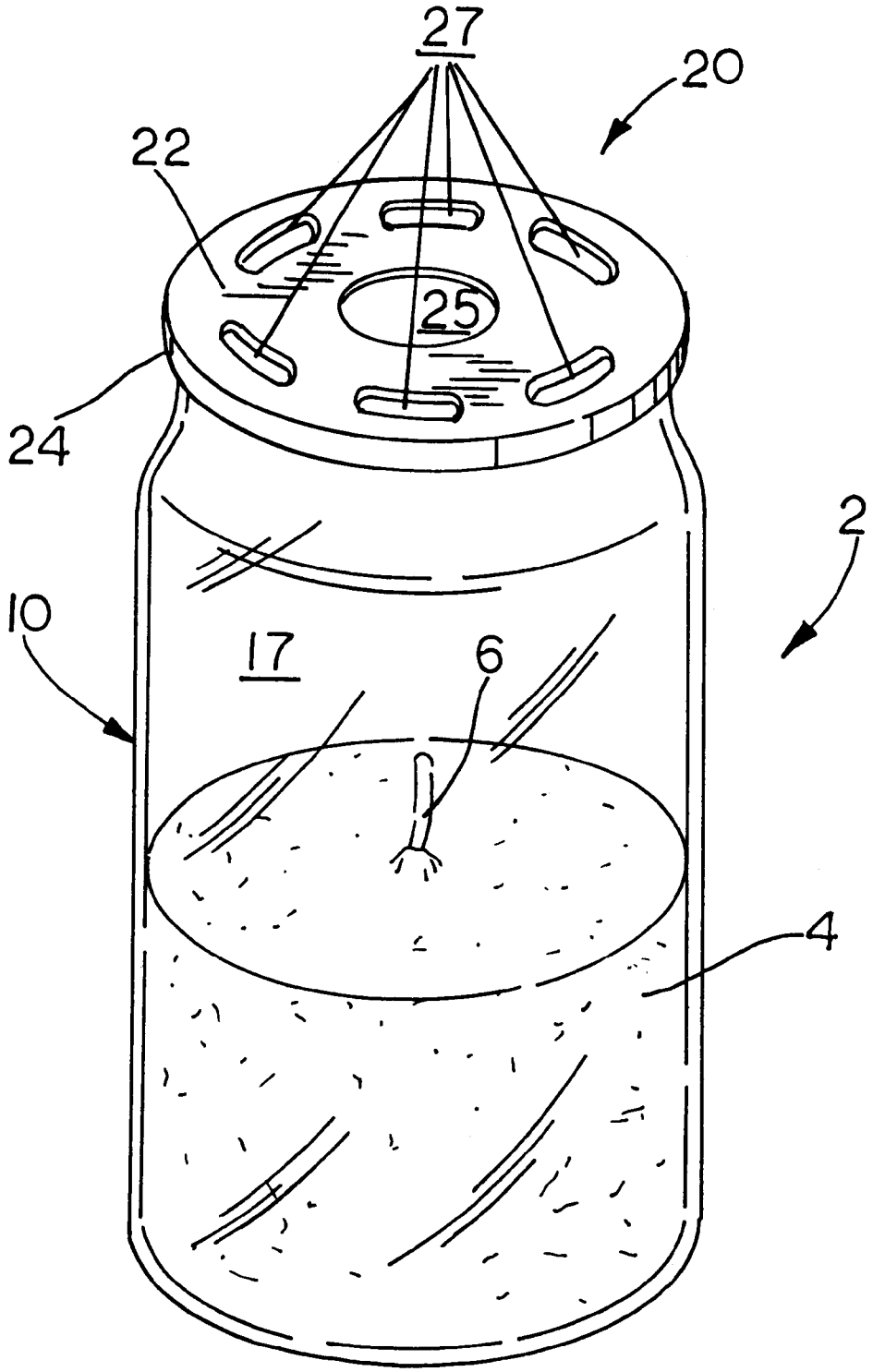
FIG. 1 is a perspective view of a containerized candle and the apparatus of this invention.

FIG. 1 shows a conventional containerized candle 2 and the venting cover 20 of this invention. As shown, candle 2 includes a quantity of wax 4, and a single cloth wick 6 contained inside a transparent or translucent glass jar or vessel 10. Wax 4 is employed in candle 2 as a fuel source and may take any natural unctuous, viscous or solid heat sensitive compound consisting essentially of high molecular weight hydrocarbons or esters of fatty acids. Candle wax 4 fills the bottom portion of jar 10 which defines an open upper interior 17 within the jar 4. Wick 6 is seated within solid wax at the center of jar 4. When candle 2 is burning, the heat from the frame 8 creates a thin layer of melted candle wax 5 across the top of the solid candle wax 4, which is drawn up wick 6 to feed the flame.

Although suitable for use with any conventional containerized candle, venting cover 20 is specifically designed and ideally suited for use with "three inch" apothecary jar candles, such as the ones manufactured by Yankee Candle, Co. of South Deerfield, Mass. As shown, jar 10 has a bottom 11 and cylindrical sidewall 12 which converge to form an annular rim 14 at its mouth 15. The descriptive term "3 inch" refers the diameter of the jar's mouth. In the candle industry, apothecary jars typically conform to certain basic dimensional standards to insure use with automated filling systems. While varying in height 3–6 inches, the typical apothecary jar varies very little, only a few tenths of an inch, in the diameters of the body and mouth. The standard apothecary jar has a cylindrical body with a diameter of approximately 4.0 inches (diameters typically vary between 4.25–3.75 inches) and a mouth having approximately a three inch diameter (diameters typically vary between 2.85–3.15 inches). Although candle 2 is illustrated as using a typical cylindrical apothecary jar, the teaching of this invention may be readily applied to containerized candles of various shapes and dimensions without deviating from the scope of the invention. The size of the jar or container and the dimensions of its mouth may vary, as well as, its shape within the scope of this invention.

Figure 2:
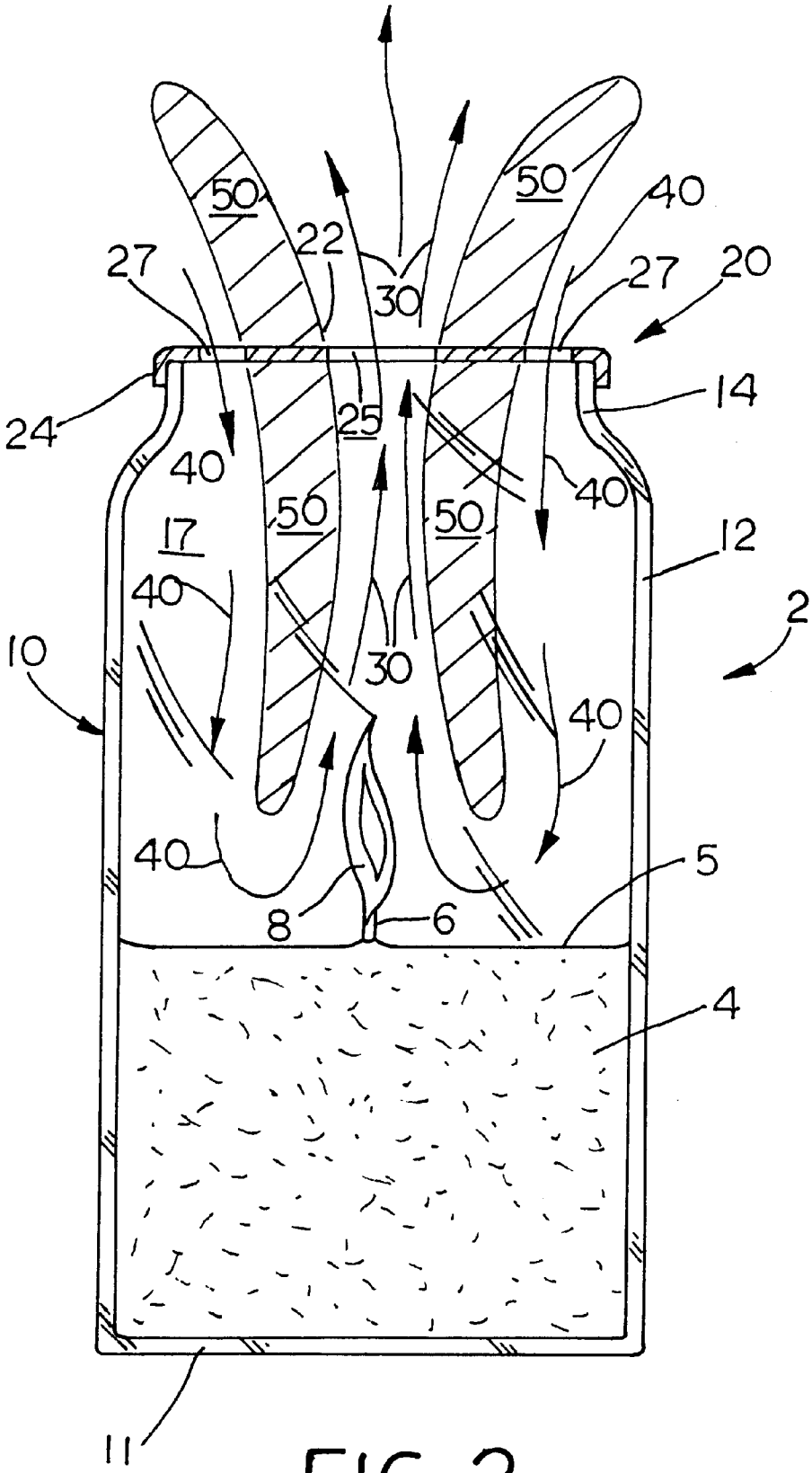
FIG. 2 is a side sectional view of the containerized candle and the apparatus of this invention showing the flow of air through the apparatus.
Figure 3:
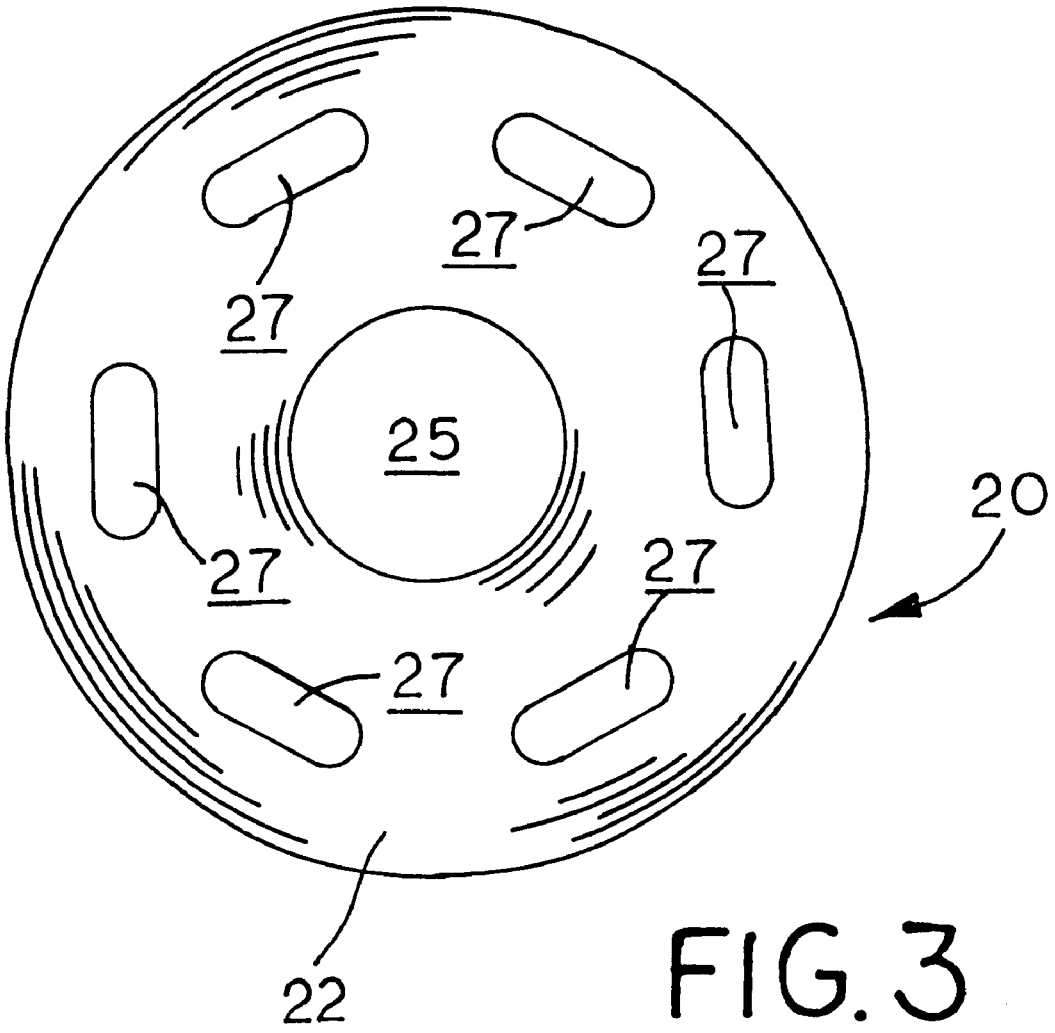
FIG. 3 is a top view of the apparatus of this invention.

As shown, venting cover 20 has a flat disc shaped body 22 formed from a sheet of metal, such as galvanized steel, brass, or pewter. Alternatively, the venting cover may be formed of a ceramic or heat resistant plastic material. As best shown in FIG. 3, cover body 22 has a circular central exhaust opening or vent 25 and six oblong inlet vents 27. Cover body 22 includes an annular flange 24 around its periphery. As shown, venting cover 20 is seated atop container mouth 15. As shown in FIG. 2, venting cover 20 is dimensioned so that the inner face of flange 24 abuts the outer edge of the jar rim 14, which helps securely seat the venting cover atop container mouth 15. With venting cover 20 seated atop jar 10, exhaust vent 25 is positioned directly above wick 6 and flame 8 and inlet vents 27 are positioned adjacent rim 14. Inlet vents 27 are spaced radially from exhaust vent 25 around the periphery of the venting cover. As shown in FIG. 1, inlet vents 27 are shaped as oblong slots, but may be shaped in any geometric configuration for aesthetic purposes. Likewise, exhaust vent 25 may be shaped in any desirable configurations, without deviating from the teaching of this invention. Although six inlet vents 27 are illustrated in the figures, any number of inlet vents may be employed, provided that they are equally spaced along the periphery of the venting cover.

FIG. 2 illustrates how venting cover 20 creates a concentric laminar air flow within interior 17 of jar 10, which stabilizes the flame and improves the efficiency of the combustion. As shown, exhaust vent 25 is positioned directly above flame 8. The thermal energy generated from flame 8 creates an upward convection flow of hot exhaust air 30, which exits interior 17 through exhaust vent 25. Positioning the exhaust vent directly above the candle flame focuses the convection draft of exhaust air directly upwards, which reduces diffusion of the exhaust flow and its thermal energy. The negative pressure within interior 17 created by exhaust air flow 30 draws an intake air flow 40 of cool ambient air into jar 10 through inlet vents 27. Intake air flow 40 circulates concentrically downward along the inside of the jar wall and converges toward wick 6 at the base of flame 8. Intake air flow 40 provides the oxidants for the combustion process. As shown in FIG. 2, the orientation of the exhaust vent and the surrounding six inlet vents provides concentric laminar air flow within the jar, which stabilizes the flame and permits sufficient air flow directly to the base of the flame. The six intake vents are spaced radially from the exhaust vent to separate the exhaust and intake airs flows. The opposing air flows through the vents are separated enough that an annular band of relative dead air (separation zone) 50 is created between exhaust and intake airflows above and below the venting cover. While air inside separation zone 50 does circulate in an eddy type flow, it circulates at a relatively lower velocity compared to the main stream of exhaust and intake air flows. Consequently, the air in the separation zones isolates the opposing air flows thereby reducing the turbulence caused by the direct mixing of the opposed exhaust and intake air flows. The separation of the opposing air flows reduces turbulence within the interior of the jar, which leads to a cleaner combustion process. The laminar air flow to the base of the flame provides sufficient oxidants to completely burn the candle wax in the combustion eliminating the carbon residue (smoke) in the exhaust. With the venting cover channeling the air flow within the jar, the candle has a cleaner more efficient combustion, which means it burns hotter, brighter and longer than without the venting cover.

The science of fluid mechanics has demonstrated that the character of air flow depends on four variables: fluid density, fluid viscosity, diameter of the flow channel, and the average velocity of fluid flow. Fluid flows with high velocity and low viscosity tend to be turbulent and flows with low velocity and high viscosity tend to be laminar. As fluid velocity increases, laminar flow changes to turbulent flow. In addition, the physical dimensions of the flow channel are also critical to predicting the flow characteristic. Larger flow channels tend to create turbulent flow. Narrower flow channels tend to create laminar flow. Since fluid density and viscosity are relatively constant within containerized candles, the characteristic of the air flow within a containerized candle is generally a product of air flow velocities and the dimensions of the container. Consequently, venting cover 20 must be dimensioned specific to the particular containerized candle in order to facilitate laminar air flow. The exhaust and inlet vents must be sized and positioned to insure sufficient air flows through the venting cover and at velocities low enough to maintain laminar air flow characteristics within the containerized candle and high enough so that the inlet air flow has inertial force to reach the base of the flame.

It should be noted that venting cover 20 as illustrated is designed for use specifically with conventional three inch apothecary jar candles, such as the ones manufactured by Yankee Candle, Co. of South Deerfield, Mass. Venting cover 20 is sized to seat atop the open mouth of conventional three inch candle jars, which dictates that the diameter of venting cover 20 is slightly greater than three inches. More importantly, the thermodynamic characteristics and physical dimensions of conventional three inch apothecary jar candles require that venting cover 20 maintains certain dimensional relationships in order to facilitate laminar air flows. These dimensional relationships are generally consistent among conventional three inch apothecary jar candles regardless of height, which typically ranges between three and six inches. Venting cover 20 has particular dimensional relationships relating to the cross sectional areas of the exhaust vent 25 and inlet vents 27, which is critical to the operation of venting cover 20 for conventional three inch apothecary jar candles. The cross-sectional area of the exhaust vent and the aggregate cross-sectional area of the inlet vents is approximately 0.785 square inches (roughly a circular opening having a 1.0 inch diameter), but may range between 0.700–0.900 square inches.. This range of the cross sectional area insures optimal exhaust venting with conventional three inch apothecary candles. The aggregate cross sectional area of inlet vents 27 is between 0.600–0.950 square inches. This range of aggregate cross sectional area insures optimal inlet flow with conventional three inch apothecary candles.

It should be further noted that regardless of size and dimensions of the jar candle or venting cover, the cross-sectional area of the exhaust vent 25 is approximately equal to the aggregate cross-sectional area of the inlet vents 27. A one to one ratio insures that equal volumes of exhaust gas and inlet air pass through venting cover 20 at approximately equal velocities. Although a one to one ratio is typically optimal, venting cover 20 can maintain laminar air flows within conventional three inch apothecary jar candles of heights between 3–6 inches for an efficient combustion with ratios of cross sectional area of exhaust vent 25 to the inlet vents ranging between 0.870–1.310. Although the number of inlets can vary with only slight effect, six radially spaced inlets are optimal for clean combustion in conventional three inch apothecary jar candles. With six inlets, the cross sectional area of each inlet vent 27 ranges 0.100–0.158 square inches. The horizontal radial distance between the exhaust and intake should be as great as possible, but a minimum of one inch should separate the geometric centers of the exhaust and each of the inlet vents. This spacing is based on the geometric centers of the inlet and exhaust vents, since the air flow through the vent tends to concentrate at the centers regardless of the shape of the respective vent.

One skilled in the art will note several advantages that the venting cover provides to the combustion process and the operation of the containerized candle. The venting cover restricts and controls the inlet and exhaust air flows into and out of the interior of the jar. The exhaust vent and the intake vents are spaced apart from each other sufficiently to facilitate separated concentric laminar air flows of exhaust and ambient air within the candle vessel to ensure that sufficient ambient air is drawn to the base of the flame. The spacing of the inlet and exhaust openings is critical to maintain separated laminar flow, while the inlet flow has sufficient downward velocity to generate the inertia force to carry the inlet flow to the base of the flame. The spacing creates an annular zone of relative still or dead air. This band of dead air acts as a physical insulator between the inlet and exhaust air flows to reduce the turbulence caused by the direct mixing of the opposed exhaust and intake air flows. Since the inlet air flow velocity must be sufficient to maintain an inertia force to carry the flow to the base of the flame, the opposed inlet and exhaust air flows must be physically separated and insulated to maintain laminar flow within the container. The ratio of the cross-sectional areas of the inlet and exhaust opening is used to maintain the inertia force and the radial spacing is used to maintain laminar flow.

One skilled in the art will note that while dimensioned for use with three inch apothecary jar candles, the venting cover of this invention can be dimensioned to facilitate laminar air flows in containerized candles of various types, sizes and dimensions. The venting cover also may be configured in various colors and styles to match the candle and decorative tastes without materially affecting its function. Consequently, the exhaust and inlet vents may take a variety of decorative configurations and shapes without deviating from the basic teachings of this invention. In addition, the venting cover of this invention when used properly with a containerized candle presents no fire or safety hazards.

Although the venting cover may be constructed of metal, which is generally a good conductor of thermal energy, the operation of the venting cover generally ensures that the venting cover does not becomes too hot to touch. Any convection heating caused by the hot exhaust exiting through the exhaust vent is countered by the convection cooling created by the cool air drawn through the inlet vents. Consequently, the venting cover never becomes hot to the touch and is therefore not a safety hazard. As long as the hand is not placed directly over the hot exhaust coming through the exhaust vent, the venting cover can be removed by hand during use without injury.

It is understood that the above description does not limit the invention to the details given, but may be modified within the scope of the following claims.

I claim:

1. A combination comprising:

an apothecary jar candle including a vessel having a cylindrical body and an open circular mouth, a fuel source disposed within the body and burnt in the flame, and a wick extending from the fuel source, and is dimensioned such that the vessel body has a diameter approximately four inches across and a height between three inches and six inches tall, and the open mouth has a diameter approximately three inches across, and a venting plate for improving the stability and efficiency of the combustion flame of the candle, the venting plate including a flat circular body dimensioned to seat atop the mouth of the vessel, the body having a central exhaust vent through which combustion exhaust exits the vessel, and a plurality of peripheral inlet vents spaced around and radially from the exhaust vent through which ambient air is drawn into the vessel, the exhaust vent has a cross sectional area greater than 0.700 square inches and less than 0.900 square inches, the plurality of inlet vents have an aggregate cross sectional area greater than 0.600 square inches and less than 0.950 square inches, the exhaust vent and the intake vents are spaced apart from each other sufficiently to facilitate separated concentric laminar air flows of exhaust and ambient air within the candle vessel to ensure that sufficient ambient air is drawn to the base of the flame when the candle burns, the exhaust vent has a cross-sectional area and the inlet vents have a cross sectional areas, such that the ratio between the cross sectional area of the exhaust vent and the aggregate cross sectional area of the plurality of inlet vents is greater than 0.870 and less than 1.310.

2. The combination of claim 1 wherein the plurality of inlet vents is six.

3. The combination of claim 1 wherein each of the plurality of inlet vents has a geometric center, the exhaust vent has a geometric center, the geometric center of each of the plurality of inlet vents is spaced from the geometric center of the exhaust vent at least 1.00 inch.

4. The combination of claim 1 wherein the exhaust vent directly overlies the flame of the containerized candle when the cover is seated atop the candle vessel and the containerized candle burns.

5. The combination of claim 1 wherein the intake vents channel the flow of ambient air to converge radially at the base of the candle flame when the containerized candle burns.

6. A combination comprising:

an apothecary jar candle including a vessel having a cylindrical body and an open circular mouth, a fuel source disposed within the body and burnt in the flame, and a wick extending from the fuel source, and is dimensioned such that the vessel body has a diameter approximately four inches across and a height between three inches and six inches tall, and the open mouth has a diameter approximately three inches across, and an venting plate for improving the stability and efficiency of the combustion flame of the candle, the venting plate including a flat circular body dimensioned to seat atop the mouth of the vessel, the body having a central exhaust vent through which combustion exhaust exits the vessel, the exhaust vent has a geometric center and a cross sectional area greater than 0.700 square inches and less than 0.900 square inches, and six peripheral inlet vents spaced around and radially from the exhaust vent through which ambient air is drawn into the vessel, each of the six inlet vents has a geometric center, the six inlet vents also have an aggregate cross sectional area greater than 0.600 square inches and less than 0.950 square inches, wherein the ratio between the cross sectional area of the exhaust vent and the aggregate cross sectional area of the plurality of inlet vents is greater than 0.870 and less than 1.310, and the exhaust vent and the six intake vents are sufficiently spaced apart from each other with the geometric centers of each of the six inlet vents are at least 1.00 inch from the geometric center of the exhaust vent, so as to facilitate separated concentric laminar air flows of exhaust and ambient air within the candle vessel to ensure that sufficient ambient air is drawn to the base of the flame when the candle burns.

* * * * *